US006232753B1

(12) United States Patent
Pasotti et al.

(10) Patent No.: US 6,232,753 B1
(45) Date of Patent: May 15, 2001

(54) VOLTAGE REGULATOR FOR DRIVING PLURAL LOADS BASED ON THE NUMBER OF LOADS BEING DRIVEN

(75) Inventors: Marco Pasotti, S. Martino Sicc.; Roberto Canegallo, Tortona; Giovanni Guaitini, Trecella; Pier Luigi Rolandi, Monleale, all of (IT)

(73) Assignee: STMicroelectronics S.r.l., Agrate Brianza (Milano) (IT)

( * ) Notice: Subject to any disclaimer, the term of this patent is extended or adjusted under 35 U.S.C. 154(b) by 0 days.

(21) Appl. No.: 09/467,726

(22) Filed: Dec. 20, 1999

(30) Foreign Application Priority Data

Dec. 22, 1998 (IT) ..... MI98A002787

(51) Int. Cl.[7] ..... G05F 1/557
(52) U.S. Cl. ..... 323/267; 323/268; 323/316
(58) Field of Search ..... 323/267, 268, 323/274, 315, 316; 307/38

(56) References Cited

U.S. PATENT DOCUMENTS 3,754,181 * 8/1973 Kreitz et al. ..... 323/267
4,280,091 * 7/1981 Hiltner ..... 323/315
4,701,694 * 10/1987 Penney et al. ..... 323/317
5,107,199 * 4/1992 Vo et al. ..... 323/316
5,208,485 * 5/1993 Krinsky et al. ..... 323/267
5,512,814 * 4/1996 Allman ..... 323/267

* cited by examiner

*Primary Examiner*—Shawn Riley
(74) *Attorney, Agent, or Firm*—Theodore E. Galanthay; Charles J. Rupnick; Seed Intellectual Property Law Group PLLC

(57) ABSTRACT

A voltage regulator is provided for limiting overcurrents when used with a plurality of loads, particularly in flash memories, which are connected between an output node of the regulator and a voltage reference by way of a plurality of switches. The voltage regulator includes at least one differential stage that has a non-inverting input terminal for a control voltage, and an inverting input terminal connected to the voltage reference and the output node of the regulator through a feedback network. There is an output terminal connected to the output node of the voltage regulator to produce an output reference voltage from a comparison of input voltages. In the voltage regulator is a main control transistor connected between a high-voltage reference and the output terminal of the regulator. Advantageously, the regulator further includes a number of balance transistors connected between the high-voltage reference and the output node of the regulator and driven according to the load being connected to the output node, thereby to shorten the duration of an overcurrent at the output terminal while delivering the current required by the loads.

15 Claims, 2 Drawing Sheets

VOLTAGE REGULATOR FOR DRIVING PLURAL LOADS BASED ON THE NUMBER OF LOADS BEING DRIVEN

TECHNICAL FIELD

This invention relates to a voltage regulator for multiple loads, and more specifically to a voltage regulator that limits overcurrents when used with multiple loads.

BACKGROUND OF THE INVENTION

Particularly, though not exclusively, the invention relates to a voltage regulator for FLASH memories, and the description to follow will specifically deal with this field of application for convenience of explanation.

As is well known, there are many types of integrated memory circuits which require on-chip voltage regulators for supplying certain system portions. As an example, FLASH memories require voltages of approximately 5V and 10V for programming their memory cells. These voltage values are provided by a voltage regulator.

Memory cell programning is markedly affected by the voltage applied to its drain terminal. In particular, with non-volatile memory cells of the FLASH type, a low value of the drain voltage results in inadequately slow cell programming, whereas an exceedingly high value results in the non-selected cells of an involved column being partly erased (the so-called "soft erasing" phenomenon).

It is generally held that a circuit including the FLASH memory should be provided with a voltage regulator of a particularly sophisticated type which can supply the cells with an appropriate drain voltage for programming.

A first prior approach consisted of a so-called differential regulation, as schematically illustrated in FIG. 1. FIG. 1 shows generally, in schematic form, a differential regulator 1 comprising a differential stage 2 which is controlled by means of a boost voltage Vpump generated by a voltage booster circuit 3. The differential regulator 1 is operative to limit the current presented on an output terminal OUT during the step of programming the memory cells connected thereto, and stabilize a programming voltage Vpd to the cells, based upon a reference voltage VREF which is received on an input terminal IN'.

The differential stage 2 has an inverting input terminal 4 arranged to receive the reference voltage VREF, and a non-inverting input terminal 5 connected to a ground reference GND and to the output terminal OUT' of the regulator through a feedback network 6 which comprises first R1 and second R2 resistive elements and a filter/compensation capacitor Cf.

In particular, the non-inverting input terminal 5 is connected to the ground reference GND via the first resistive element R1, and connected to the output terminal OUT' via the second resistive element R2. Furthermore, the output terminal OUT' itself is connected to the ground reference GND via a filter/compensation capacitor Cf.

The differential stage 2 also has an output terminal 7 which is connected to the output terminal OUT' of the differential regulator 1 and feedback connected to a supply terminal 8 via a connection transistor M1. The supply terminal 8 of the differential stage 2 is further connected to the booster circuit 3 supplying the boost voltage Vpump.

In the conventional differential regulator 1, the programming voltage Vpd is derived from a control voltage $V_{REF}$ being delivered to the inverting input terminal 4 of the differential stage 2.

Nevertheless, this prior differential regulator 1 has certain drawbacks of which a major one is the use of a PMOS transistor for the connection transistor M1. The PMOS transistor must have a common source configuration, and accordingly, the loop gain of the structure that contains the differential regulator 1 is made to depend on the number of programmed cells, resulting in increased loop gain. Thus, the capacitor Cf must be provided oversized in order to suit the critical case, such that the structure stability can be ensured under all conditions of operation. This disadvantageously increases the silicon area requirements for integrating the whole structure.

In addition, at the programming stage, a large current begins to flow to the terminals of the memory cells to be programmed. Accordingly, the programming voltage Vpd drops sharply, and the differential stage 2 is allowed to depart from its linear dynamic range and lose its clamp to the programming voltage Vpd. The PMOS connection transistor M1 keep conducting but is unable to control the flow of current to the memory cells being programmed, again by reason of its common source configuration.

The output terminal OUT', where the programming voltage Vpd appears, is then re-charged without any control by the feedback that, in a normal situation, the differential stage 2 would introduce. This situation persists until the differential stage 2 is restored to its linear dynamic range. This may result in objectionable peaking of the drain voltage of the cells being programmed.

Thus, the only way to correct this dangerous situation is to use filter/compensation capacitors Cf of a very high capacitance, with the consequence of disadvantageously increasing the integration area requirements, as previously mentioned.

Furthermore, it should be recalled that in operation of a memory circuit, e.g., of the FLASH type, constructed of cell matrices, several loads may happen to be supplied from the same regulator. As a load is disconnected from the regulator, the power stage of the latter theoretically at once depresses the current being delivered in order to keep the voltage constant.

In actual practice, the feedback loop of the regulator would re-establish the normal condition of operation with some delay, partly dependent on non-linear effects ("slew rate" effect) and on linear effects ("finite band" effect).

During this transient period, the output node of the regulator would be at a higher voltage than is appropriate. This situation can make the immediate clamping of other loads to the regulator problematical.

For example, once a FLASH memory cell programming is completed and the cell is disconnected from the regulator output, a voltage peak would develop at the output. Consequently, the connection of another cell must be deferred, because there is a risk of overprogramming the threshold. This must be prevented, especially with analog FLASH memory cells.

A second prior approach to obviating these deficiencies is described in Italian Patent Application No. MI97A002594, filed by this Applicant on Nov. 21, 1997, and integrated herein by reference.

This document discloses a differential type voltage regulator including a connection transistor which has been modified and configured to drive at its output any number of memory cells, without affecting the loop gain of the structure which contains the regulator and the cells to be driven.

In particular, the modified connection transistor removes the dependence of the structure overall loop gain $G_{LOOP}$ on the current draw by the driven memory cells. In essence, it is a matter of using a transistor in a source-follower configuration, in particular an NMOS transistor formed from a triple well structure. Not even this prior approach can solve the problems of driving different loads, in particular correct the retarded clamping of a new load, because of the persistence of the overvoltage which is brought about by the driving of the load previously clamped to the regulator.

Thus, nowhere in the prior art is a solution able to provide a voltage regulator whereby a number of loads can be driven with no appreciable delay, and the limitations of prior art regulators be overcome.

SUMMARY OF THE INVENTION

Embodiments of this invention use a finite number of MOS transistors connected to the output node of the regulator and driven by means of suitable switches. In this way, the output stage of the regulator is controlled as a function of the applied load.

Based on this principle, embodiments of the invention include a voltage regulator for a number of loads connected between an output node of the regulator and a voltage reference by way of a number of switches. In the voltage regulator is at least one differential stage having: a non-inverting input terminal to receive a control voltage; an inverting input terminal connected to the voltage reference and the output node of the regulator through a feedback network; an output terminal connected to the output node of the voltage regulator to produce an output reference voltage from a comparison of input voltages. Also included is a main control transistor connected between a high-voltage reference and the output terminal of the regulator and a plurality of balance transistors connected between the high-voltage reference and the output node of the regulator and driven according to the load being connected to said output node, thereby shortening the duration of an overcurrent at said output terminal while delivering the current required by said loads.

In some embodiments of this invention, the balance transistors are each connected to the high-voltage reference via a respective switch and are sized to suit the draw by said load plurality.

According to another aspect of the invention, the balance transistors and main control transistor have their control terminals connected together and to the output terminal of the differential stage. According to a further aspect of the invention, the balance transistors are MOS power transistors.

The features and advantages of the voltage regulator can be more clearly understood by reading the following description of an embodiment thereof, given by way of example and not of limitation with reference to the accompanying drawings.

DETAILED DESCRIPTION

A typical voltage regulator basically comprises, within its output stage, a P- or N-channel MOS transistor which is driven by means of a differential stage to deliver the current required by a load connected to the voltage regulator.

Assuming the draw by each internal block of the system connected to the regulator is a known quantity, the output stage of the voltage regulator of this invention must be dimensioned to suit the applied load.

Figure 1:
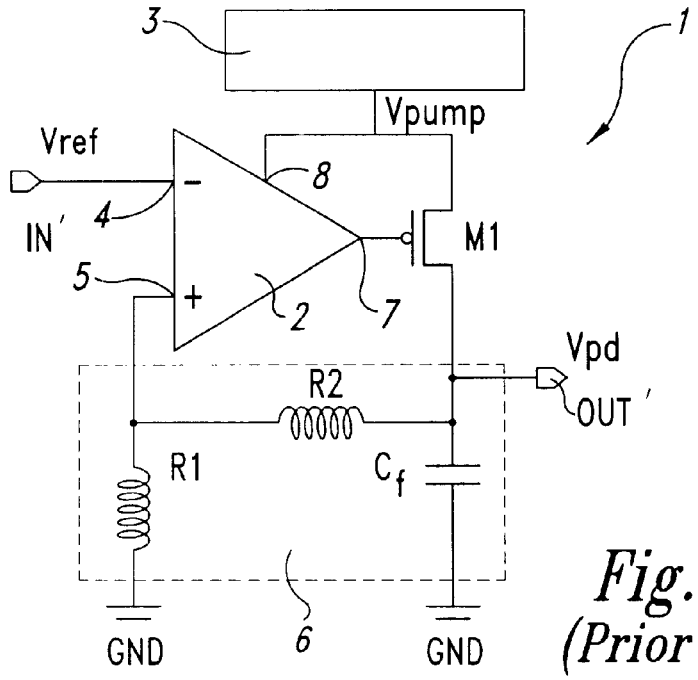
Fig. 1 (Prior Art)
FIG. 1 is a schematic diagram showing a conventional differential regulator of the programming voltage for a memory cell.
Figure 2:
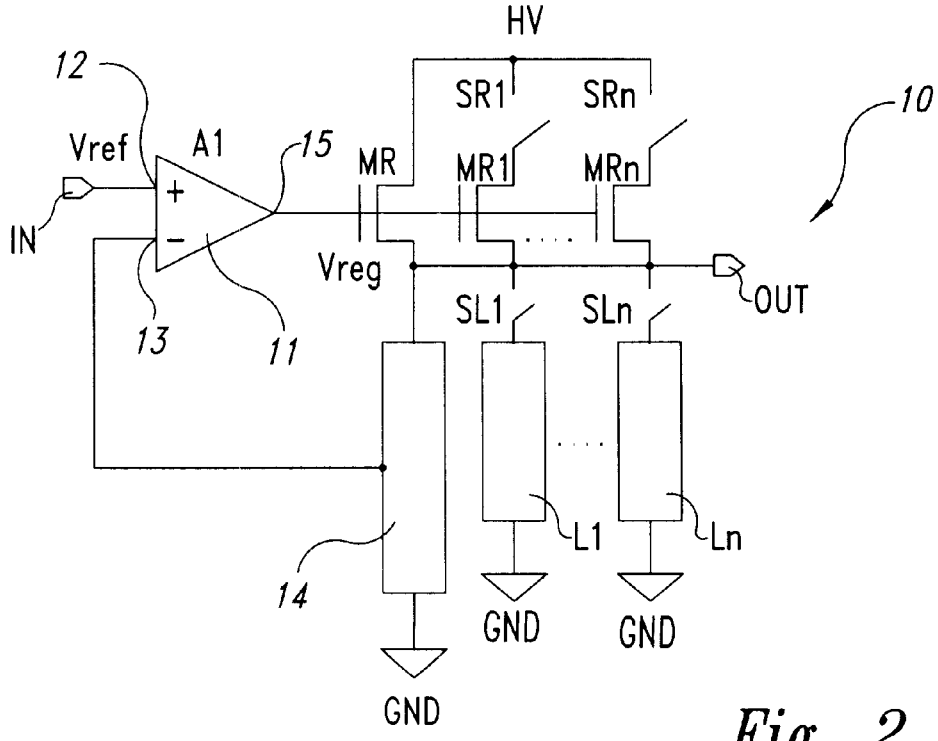
FIG. 2 is a schematic diagram showing a differential regulator according to an embodiment of the invention.

A voltage regulator 10 according to an embodiment of the invention is shown in FIG. 2. This regulator 10 has an input terminal IN connected to a voltage reference VREF, and has an output node OUT adapted for connection, via a number of switches SL1, . . . , SLn, to a number of loads L1, . . . , Ln which are, in turn, connected to a voltage reference, such as a ground GND.

The voltage regulator 10 also includes a differential stage 11 having a non-inverting input terminal 12 which is connected to the input terminal IN, and having an inverting input terminal 13 which is connected to the output node OUT of the regulator 10 through a feedback network 14. The differential stage 11 also has an output terminal 15 connected to the output node OUT of the regulator 10 via a main control transistor MR, itself connected between said output node OUT and a high-voltage reference HV.

Advantageously in embodiments of this invention, the regulator 10 further includes a plurality of balance transistors MR1, . . . , MRn which are connected to the output node OUT, and connected to the high-voltage reference HV by way of a number of switches SR1, . . . , SRn.

The balance transistors MR1, . . . , MRn and the main control transistor MR have their control terminals connected together and to the output terminal 15 of the differential stage 11.

In an advantageous embodiment of this invention, the balance transistors MR1, . . . , MRn are MOS power transistors.

The operation of the inventive regulator 10 will now be described

Upon a first load L1 being connected to the output node OUT, the first switch SR1 will enable the first balance transistor MR1. Likewise, upon the second load L2 being connected to the output node OUT, the second switch SR2 will enable the second balance transistor MR2; and so on through all of the balance transistors MR1, . . . , MRn provided.

The main control transistor MR is held on all the time, to allow the regulator 10 to operate correctly even if in a no-load condition.

Advantageously in this invention, the size of the balance transistors MR1, MR2, . . . , MRn is in direct proportion to the draw by the respective loads, so that these can be each delivered approximately the amount of current they require.

Upon the first load L1 being disconnected from the system by means of the switch SL1, the corresponding balance transistor MR1 is turned off, thereby instantly decreasing the current being delivered by an amount approximately equal to that drawn by the load L1, and presently no longer necessary. In this way, the overcurrent at the output node OUT is greatly reduced, and the system as a whole sees its duration in a condition of non-linearity, and with it the duration of the objectionable output overvoltage, shortened.

Figure 3:
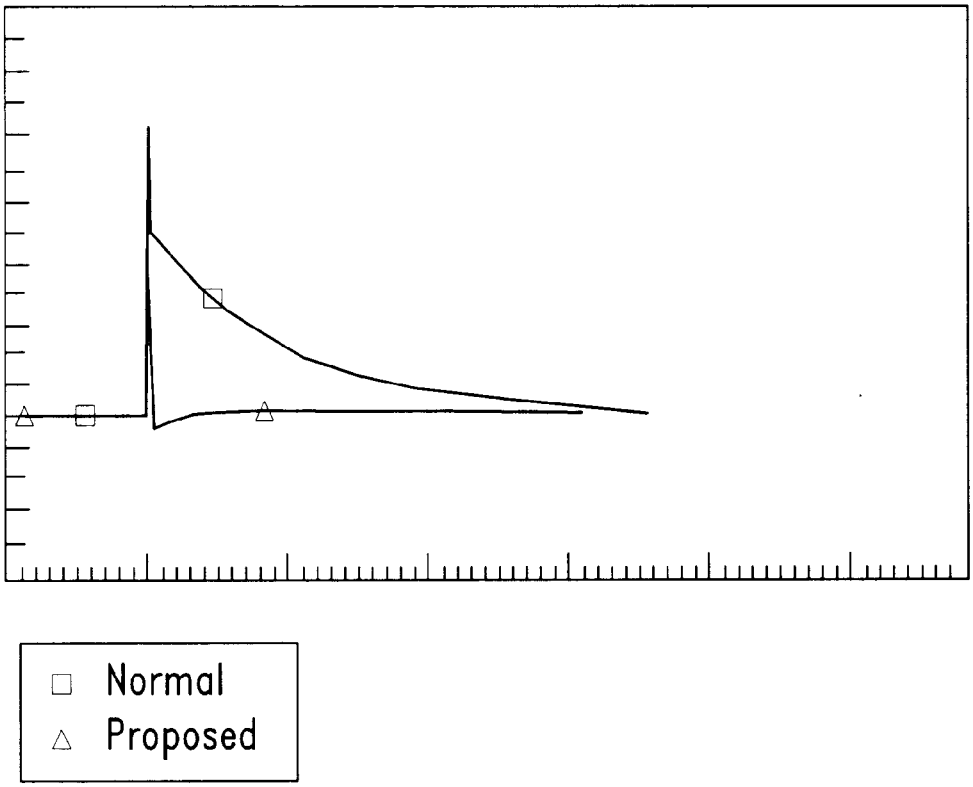
FIG. 3 is a graph showing the results of a simulated comparison of a conventional regulator with a regulator according to the embodiment of the invention shown in FIG. 2.

Shown in FIG. 3 are the results of two simulations conducted by the Applicant for a regulator at 5V. In particular, the transient output overvoltages of a prior art regulator and a regulator according to the embodiment of the invention shown in FIG. 2 are compared in that figure.

Under similar conditions of draw by the loads, the duration of the overvoltage upon disconnecting the loads from the regulator appears to be shorter. In fact, the overvoltage time of the conventional regulator is dependent on saturation of the gain stage, whereas that of the regulator according to this invention is only tied to the delay in turning off the switch. Thus, the regulator 10 of embodiments of this invention has its output stage optimized to suit the load being applied to the regulator.

The embodiment of the regulator according to the invention described in the foregoing employs N-channel MOS transistors. However, a corresponding embodiment using P-channel MOS transistors and based on the same inventive principle could be envisaged.

It should be noted that the regulator 10 of embodiments of this invention can be used to drive any multiple number of loads, not necessarily related to memory cells, and that the reference to this field of application in the specification has merely been made for convenience of illustration and to expound a most advantageous potential application of the regulator.

Changes can be made to the invention in light of the above detailed description. In general, in the following claims, the terms used should not be construed to limit the invention to the specific embodiments disclosed in the specification and the claims, but should be construed to include all methods and devices that are in accordance with the claims. Accordingly, the invention is not limited by the disclosure, but instead its scope is to be determined by the following claims.

What is claimed is:

1. A voltage regulator for limiting overcurrents when used with a plurality of loads which are coupled between an output node of the regulator and a voltage reference via a plurality of switches, the voltage regulator comprising:

at least one differential stage having:

a non-inverting input terminal structured to receive a control voltage, an inverting input terminal coupled to the voltage reference and the output node of the regulator through a feedback network, an output terminal that supplies an output reference voltage from a comparison of input voltages;

a main control transistor connected between a high-voltage reference and the output node of the regulator; and a plurality of balance transistors connected between the high-voltage reference and the output node of the regulator and each driven according to a respective one of the plurality of loads being connected to said output node of the regulator, and structured to shorten the duration of an overcurrent at said output node of the regulator while delivering the current required by said respective ones of said plurality of loads.

2. The voltage regulator according to claim 1, wherein said plurality of balance transistors are each connected to the high-voltage reference via a respective switch.

3. The voltage regulator according to claim 1, wherein said plurality of balance transistors are sized according to a draw by the respective one of plurality of loads.

4. The voltage regulator according to claim 1, wherein said plurality of balance transistors and the main control transistor have control terminals connected together and to the output terminal of the differential stage.

5. The voltage regulator according to claim 1, wherein said plurality of balance transistors are MOS power transistors.

6. A voltage regulator structured to supply a stable voltage to one or more loads, comprising:

a differential stage having a non-inverting input terminal structured to receive a control voltage, a differential output node, and an inverting input terminal coupled to differential output node through a feedback network, the inverting input terminal also coupled to a reference voltage;

a main control transistor connected between a high-voltage reference and an output terminal of the voltage regulator, the main control transistor having a control terminal coupled to the differential output node; and one or more additional transistors each switchably connected through a first respective one or more switches between the high-voltage reference and the output terminal of the voltage regulator; and one or more additional loads each switchably connected through a second respective one or more switches between the output terminal of the voltage regulator and the reference voltage, and each of the one or more additional loads related to a specific one of the one or more additional transistors;

wherein for each of the one or more additional loads connected through the second respective one or more respective switches to the output terminal, the first respective switch couples the related one or more additional transistors to the high-voltage reference.

7. The voltage regulator of claim 6, wherein the one or more additional transistors are sized according to a draw by the related one or more additional loads.

8. The voltage regulator of claim 6, wherein the one or more additional transistors have control terminals connected together and to the differential output node.

9. The voltage regulator according to claim 6, wherein the one or more additional transistors are MOS power transistors.

10. A method for regulating a stable voltage provided to one or more loads at an output terminal of a voltage regulator, the method comprising:

providing an output of a differential stage to a control terminal of a first transistor that is coupled between a high voltage reference and a second reference voltage through a resistive load; and for every additional load coupled to the output terminal of the voltage regulator, coupling an appropriately sized transistor between the high voltage reference and the output terminal of the voltage regulator, and coupling a control terminal of the appropriately sized transistor to the output of the differential stage.

11. The method of claim 10 wherein each appropriately sized transistor is an MOS power transistor.

12. The method of claim 10 wherein the appropriate size of the appropriately sized transistor is related to a draw of the respective additional load.

13. The method of claim 10 wherein, if any of the additional loads are disconnected from the output termninal of the voltage regulator, the related appropriately sized transistor is uncoupled from the high voltage reference.

14. The method of claim 10 wherein the output of the differential stage is provided by a differential amplifier having a non-inverting input coupled to a third voltage reference, and having an inverting input coupled to the output terminal of the voltage regulator through a resistive network.

15. The method of claim 10 wherein the first transistor is always coupled to the high voltage reference, and always coupled to the resistive load.

* * * * *